United States Patent [19]

Cervantes

[11] 4,299,045

[45] Nov. 10, 1981

[54] BACKPLATE FOR A DETACHABLE GUN LOCK

[76] Inventor: Ramon H. Cervantes, 4600 78th St., Sacramento, Calif. 95820

[21] Appl. No.: 59,181

[22] Filed: Jul. 20, 1979

[51] Int. Cl.[3] ..... F41C 27/10

[52] U.S. Cl. ..... 42/1 Y; 42/1 LP

[58] Field of Search ..... 42/1 Y, 1 LP; 248/309 A, 309 R

[56] References Cited

U.S. PATENT DOCUMENTS

| | | | |
|---|---|---|---|
| 3,031,787 | 5/1962 | Womble, Jr. | 42/1 Y |
| 4,050,662 | 9/1977 | Pickering | 42/1 Y |
| 4,084,341 | 4/1978 | Cervantes | 42/1 Y |
| 4,198,026 | 4/1980 | Capolupo | 42/1 Y |

*Primary Examiner*—Charles T. Jordan

*Attorney, Agent, or Firm*—Blair, Brown & Kreten

[57] ABSTRACT

Disclosed herein is an improvement on a backplate which is used to hold and lock a gun. The improvements include providing stop elements on various parts of the backplate so as to not only constrain the gun from rotation around the trigger guard, but also to provide an additional structure which will prevent the hammer of a gun from being cocked and fired.

9 Claims, 12 Drawing Figures

FIG.1
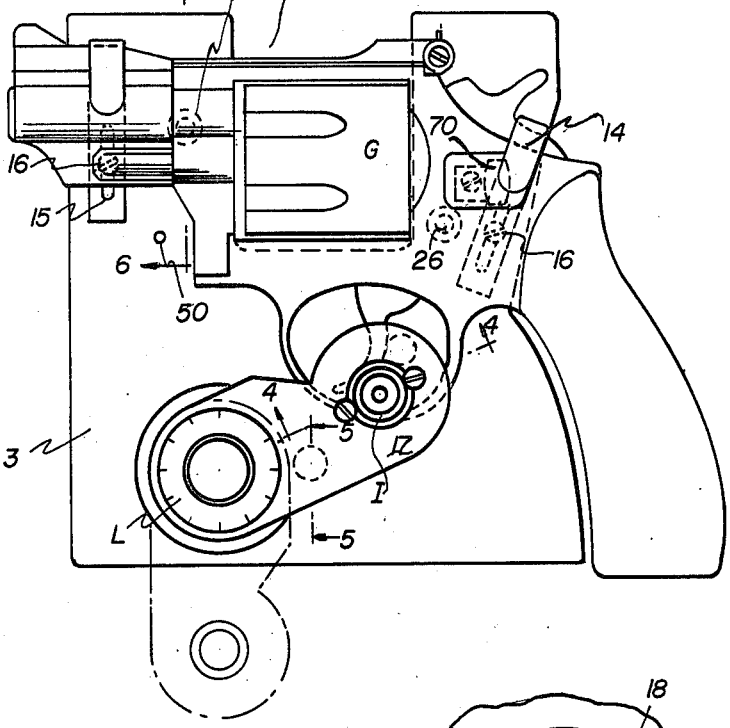
FIG.2
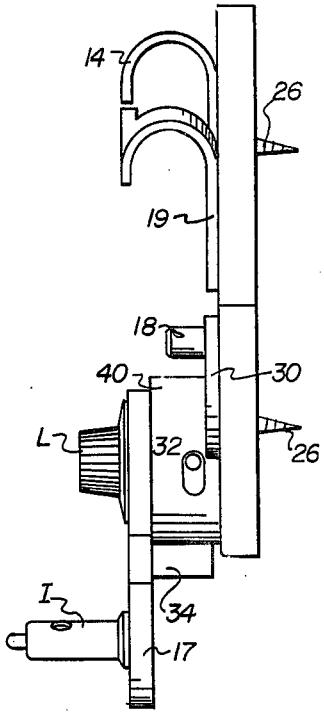
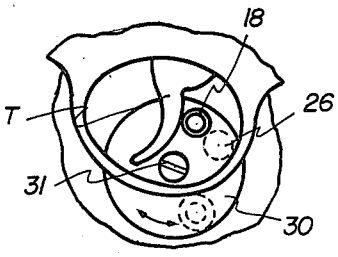
FIG.3
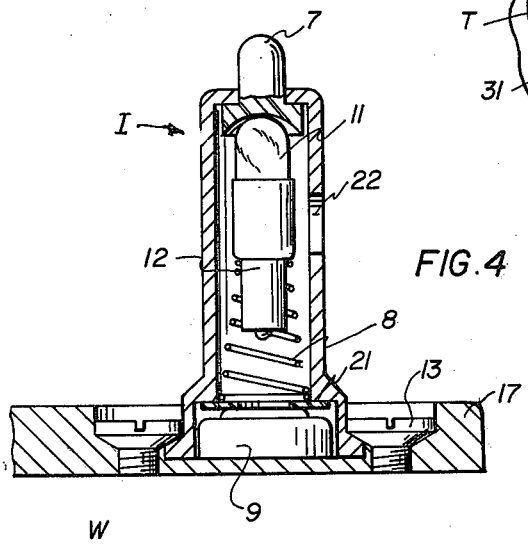
FIG.4
FIG.5
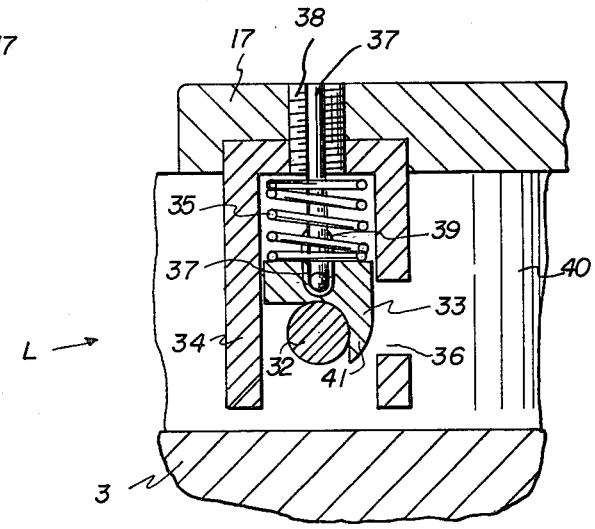
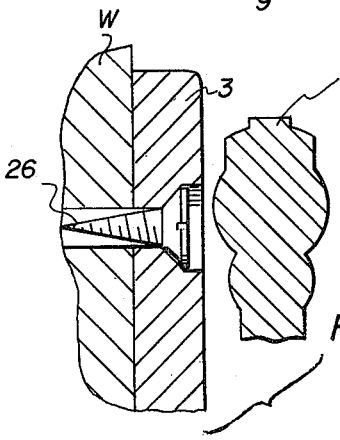
FIG.6

BACKPLATE FOR A DETACHABLE GUN LOCK

BACKGROUND OF THE INVENTION

The ensuing detailed description and claims relate to improvements in my earlier U.S. Pat. No. 4,084,341 issued Apr. 18, 1978.

SUMMARY OF THE INVENTION

In an attempt to decrease the likelihood that the hammer portion of the gun can be used to actuate the weapon, additional constraints are seen to be desirable.

Accordingly, an object of this invention is to provide constraints on the hammer as well as other portions of a gun so that the gun can not be actuated by means of the hammer exclusively, nor can the gun be rotated relative to a gun lock disposed upon the trigger guard.

A further object contemplates providing a cut-away portion on the backing plate proximate to the chamber area of the pistol that stores the bullets so that the gun may be allowed to come closer to the backing plate than if the cut-away portion were not present.

These and other objects will be made manifest when considering the following detailed specification and drawing figures.

BRIEF DESCRIPTION OF THE DRAWINGS

FIG. 1 shows a front plan view of a preferred embodiment for constraining the gun from relative rotation and actuation of the hammer;

FIG. 2 is an end view thereof;

FIG. 3 shows details of the trigger guard area;

FIG. 4 is a sectional view taken along lines 4—4 of FIG. 1;

FIG. 5 is a sectional view taken along lines 5—5 of FIG. 1;

FIG. 6 is a sectional view taken along lines 6—6 of FIG. 1;

DESCRIPTION OF THE PREFERRED EMBODIMENT

Figure 7:
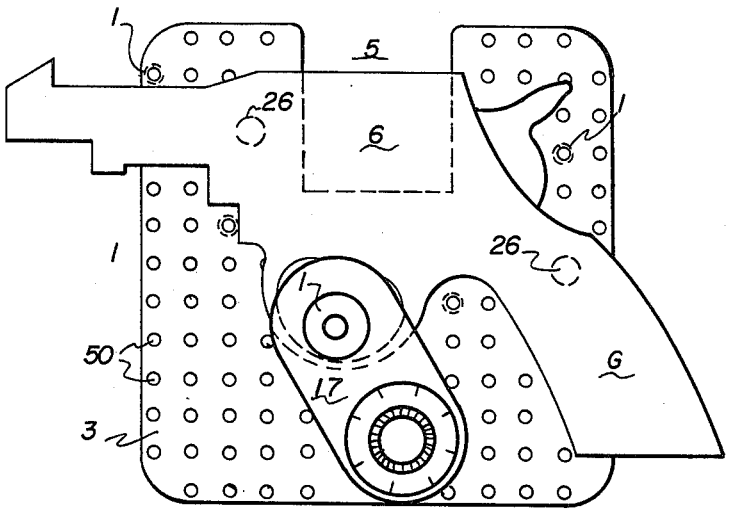
FIG. 7 is a front plan view of a second form of the apparatus according to the present invention showing the pin elements to constrain the gun from relative rotation.
Figure 8:
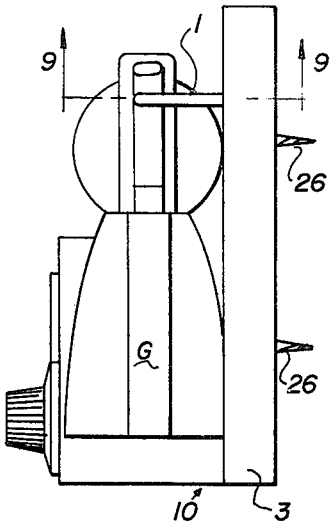
FIG. 8 is an end view thereof.

Referring to the drawings now, wherein like reference numerals refer to like parts throughout the several drawings, reference numeral 10 is directed to the gun lock according to the present invention. Operations of those components which share structural similarities with my earlier patent will not be detailed herein but said structure is incorporated by reference.

Briefly, the apparatus according to the present invention comprises a backing plate 3 which serves to support a lock L which pivots a post 18 through a connecting link or bolt 17 having a source of illumination I which is limited to reside near the trigger guard area of a gun.

FIGS. 1,2, and 5 detail a preferred form of the invention in which the constraining elements are formed with hook type retention clips 14 having an arcuate top portion, a planar stem portion 19 which is fastened to register with the base 3, a slot 15 disposed on the stem portion and a screw element 16 which fastens the arcuate hook clip to the base 3. As shown in FIGS. 1 and 2, the hook elements are disposed one nearest the barrel to constrain said barrel, and one directly behind the hammer so as to prevent the hammer from being pulled backwards. This last hook covers the cylinder lock 70 so that the bullets cannot be removed. The cutaway portion 5 is shown in FIG. 1, and allows the gun cylinder to nest therein.

FIG. 4 shows details of the illumination device and the latch 17 which extend over the trigger guard. The illumination device I has a push button 7 which coacts against the bulb 11 having a stem portion 12 which is normally biased upwardly through spring 8 in the rest position. By depressing the button 7, the stem portion 12 extends below to a battery 9 having a contact on the top surface thereof which is surrounded by a nylon washer 21 in a preferred form so as to insure that the battery is isolated from the spring 8. The illumination device I is screwed to the base of the bolt 17 by screws 13 as shown in FIG. 4. An opening 22 is provided to allow the light bulb to shine on the combination lock L.

FIG. 3 specifies the details of post 18 which prevents the trigger T from being manipulated. The post 18 is supported on a circumferentially beveled disc 30 which is fastened to the base 3 via a central screw 31. The screw 31 can be loosened to allow post 18 to rotate so as to provide adjustment, allowing different trigger configurations to be similarly blocked.

FIG. 5 teaches the lock structure wherein bolt 17 has depending therefrom a cylinder 34 provided with an opening 36 for reception of the lock pin 32 disposed on lock shroud 40 into latch 33. The latch 33 is biased downwardly through spring 35 and the latch 33 being substantially of inverted L shaped configuration having a rounded lower tip outer portion which terminates in a point, cannot rotate due to the pin 37 which communicates with a groove 39 on the inner face of cylinder 34. Pin 37 is substantially "L" shaped and extends from the groove 39 through to the top of the bolt 17 via an opening 38. The cylinder 34 may be threaded into the bolt, pressed in or fastened thereto by screws. To release the lock, the pin 32 retracts (FIG. 5) or rotates away (FIG. 2) by virtue of the slot on shroud 40.

FIG. 6 teaches that all screws 26 which fasten the backing plate to a wall W are hidden when the gun is in place so as to make its removal impossible. Further, the screws 16 which fasten the hooks 14 are similarly hidden when the gun G is in place (FIG. 1).

Figure 9:
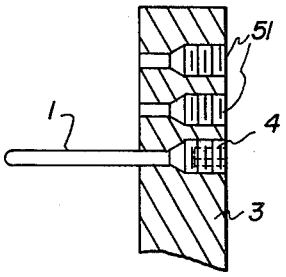
FIG. 9 is a sectional view taken along lines 9—9 of FIG. 8.
Figure 10:
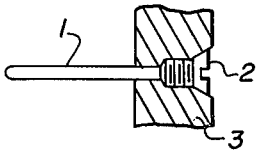
FIG. 10 is an alternative structure to that which is shown in FIG. 9.

In a second form of the invention, as shown in FIGS. 7 through 12, the improvement comprises providing a backing plate 3 with a plurality of holes therein which can be used to threadedly insert pin elements 1 as by a screw head 2 and threaded section extending therebetween. As shown in FIG. 9 an alternative embodiment may be used to use an allen screw 4 with pin 1 to fasten same into the backing plate 3 through threaded bore 51. The disposition of these pins as shown in the drawing figures includes providing one on either side of the pistol barrel as well as directly behind the hammer of the pistol and near the hand grip between the trigger guard and the handle so that the pistol cannot be rotated relative to the lock and trigger guard, and also prevent the hammer from being cocked while on the plate.

In a preferred form, there is a cut-away portion 5 on the backing plate so that the cylinder 6 of the pistol which receives the bullets will nest therein so as to allow the pistol to rest more closely to the backing plate 3.

Figure 11:
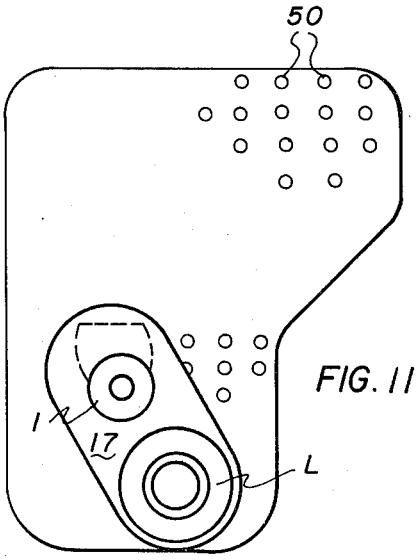
FIG. 11 details an alternative configuration for the backing plate shown in FIG. 7.
Figure 12:
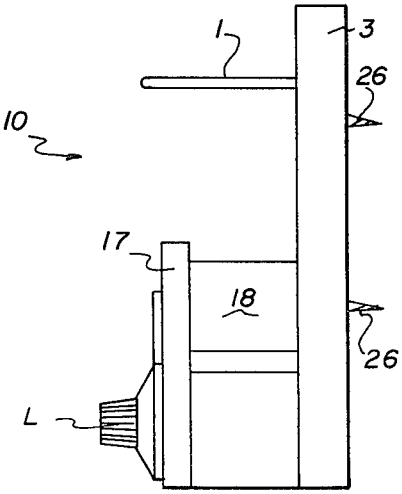
FIG. 12 is an end view of that shown in FIG. 11.

FIG. 11 makes it evident that the disposition of these pins can be varied by the purchaser of the lock and backing plate so as to accommodate guns of different geometrical configurations and that the configuration of the backing plate can be varible in accordance with the type of weapon to be constrained. Further, it should be apparent that while only pistols have been illustrated in the instant application, backing plates of suitable configuration and pins suitably disposed could be utilized to constrain a rifle in a similar manner.

Having thus described the invention, it should be apparent that numerous structural modifications are contemplated as being a part of this invention as set forth hereinabove and as defined hereinbelow by the claims. Also numeral 50 indicates holes for mounting and are spaced to accommodate different size guns and is provided to reposition clip 14 or pin 1 as desired.

I claim:

1. An improvement for a detachable gun lock which includes a backing plate, a stem portion extending from said back plate caused to enter within a trigger guard of a hand gun, and a bolt connecting said stem portion to a lock, the improvement comprising means on said backing plate to prevent the gun from rotating about said stem which extends into the trigger guard in which said means to prevent rotation includes a plurality of pin elements extending through said backing plate and affixed thereto, in which at least one of said pins is disposed behind a hammer of the hand gun.

2. The device of claim 1 in which an additional pin is disposed between the trigger guard and the handle.

3. The device of claim 2 including a pair of pins disposed on opposed sides of a barrel of a hand gun.

4. The device of claim 1 in which said means to prevent the hand gun from rotation around the stem disposed in the trigger guard comprises at least one arcuate hook extending from said pin element having a stem portion fastened to said backing plate along said stem portion disposed behind a hammer of a hand gun whereby said hook lies behind the hammer and prevents its being cocked.

5. The device of claim 4 in which a second arcuate hook portion having a stem fastened to said back plate is disposed near the barrel so that said arcuate hook portions overlie the barrel.

6. The device of claim 5 wherein each of said stem portions is provided with a slot so that a screw extending therethrough and fastened to said backing plate can provide orientation of the hooks to accomodate guns of different dimensions.

7. The device of claim 3 or 6 in which the lock includes an illumination means extending over the stem which enters into the trigger guard and is connected to a lock means through a bolt, said illumination means defined by a housing, a push button disposed on the top face thereof, a bulb disposed within the housing in registry with the push button having a lower stem portion, spring means causing said bulb to normally press against said button, and a battery disposed below said spring means surrounded by a washer whereby when said push button is pushed down, the bulb's stem portion engages the battery and provides illumination to an opening in the illumination device's housing and said washer isolates said battery from said spring means.

8. The device of claim 7 in which said lock is disposed within a shroud having a pin extending outwardly therefrom, said pin being moveable by said lock, and a cylinder downwardly extending from said bolt having a latch therein to coact with said pin so when said pin and said latch are cofastened, the gun is locked in place, and said latch is normally biased downwardly and shroud is provided with means to rotate said pin relative to said cylinder.

9. The device of claim 8 in which said backplate is fastened to a wall through screw means and said screw means are hidden by the gun and lock, and further said gun hides the screws which retain the gun on said backplate, and a further screw is provided under a beveled disc to retain further said backplate to the wall.

* * * * *